United States Patent [19]

Watanabe et al.

[11] 4,452,731

[45] Jun. 5, 1984

[54] CLEANER FOR OVENS AND THE LIKE USING SODIUM ALPHA OLEFIN SULFONATE AND SODIUM SILICATE

[75] Inventors: Henry Watanabe, Vernon Hills; Andrew Schultz, Deerfield, both of Ill.

[73] Assignee: Stepan Chemical Company, Northfield, Ill.

[21] Appl. No.: 407,156

[22] Filed: Aug. 11, 1982

[51] Int. Cl.[3] ..... C11D 1/14; C11D 3/08; C11D 11/00

[52] U.S. Cl. ..... 252/536; 252/90; 252/156

[58] Field of Search ..... 252/536, 555, 156, 174, 252/90

[56] References Cited

U.S. PATENT DOCUMENTS

| | | | |
|---|---|---|---|
| 3,335,092 | 8/1967 | Perry | 252/158 |
| 3,640,880 | 2/1972 | Martin | 252/555 |
| 3,950,276 | 4/1976 | Grand | 252/536 |
| 3,954,676 | 5/1976 | Tuvell | 252/548 |
| 3,954,679 | 5/1976 | Wixon | 252/555 |
| 4,006,091 | 2/1971 | Lindblom et al. | 252/90 |
| 4,006,111 | 2/1977 | Malhotra et al. | 252/555 |
| 4,111,853 | 9/1978 | Shultz et al. | 252/536 |
| 4,139,498 | 2/1979 | Kawakami et al. | 252/555 |
| 4,153,571 | 8/1979 | Garvin et al. | 252/156 |
| 4,157,921 | 6/1979 | Baturay et al. | 134/4 |
| 4,244,840 | 1/1981 | Straw | 252/540 |

*Primary Examiner*—P. E. Willis, Jr.

*Attorney, Agent, or Firm*—Hill, Van Santen, Steadman & Simpson

[57] ABSTRACT

A dilute aqueous solution of sodium alpha olefin sulfonate with sodium silicate displays surprisingly high viscosity characteristics and is useful as an oven cleaner or metal cleaner.

20 Claims, 5 Drawing Figures

CLEANER FOR OVENS AND THE LIKE USING SODIUM ALPHA OLEFIN SULFONATE AND SODIUM SILICATE

BACKGROUND OF THE INVENTION

1. Field of the Invention

This invention lies in the field of metal and enamel cleaning compositions, particularly compositions adapted for the treatment of surfaces fouled with carbonaceous deposits.

2. Description of the Prior Art

Oven cleaners are intended to remove carbonaceous (including proteinaceous) deposits and residues retained on oven surfaces as a result of baking, broiling or other cooking operations, and such products are available as liquids, pastes, and aerosols.

Typically, an oven cleaner formulation apparently contains surfactant, carrier liquid or solvent, optionally cleaning additives (which can include caustic material), and perhaps also thickening agents. An aerosol additionally contains a propellant.

So far as now known, thickeners previously employed in this art have been gums, starches, and, perhaps, complex colloidal magnesium aluminum silicate. Sodium silicate has never previously been used as a thickening agent so far as now known.

Metal and enamel cleaning compositions appear to have a wide variety of applications, including oven cleaning, food processing equipment cleaning, and the like.

BRIEF SUMMARY OF THE INVENTION

More particularly, this invention relates to new and very useful homogeneous compositions for cleaning surfaces, particularly surfaces contaminated with carbonaceous (including proteinaceous) deposits, or the like, such as occur on the interior walls of ovens used for the baking or broiling of foodstuffs, such as meats, on the interior walls of vessels used for the processing of food, on equipment used for pasteurization of milk, on peripheral equipment, such as grills, stove tops, etc., and the like. Paint stripping, and the like can also be accomplished Such a composition comprises on a 100 weight percent total composition basis:

(A) from about 3 to 14 weight percent of a sodium alpha olefin sulfonate derived from at least one alpha olefin containing from 12 to 18 carbon atoms per molecule, (B) from about 0.15 to 0.7 weight percent of salt selected from the group consisting of sodium chloride and sodium sulfate, (C) from about 7 to 15 weight percent of sodium silicate having an $SiO_2/Na_2O$ weight ratio of 3.2:1 to 1:2, and (D) from about 70.3 to 90 weight percent of water, said composition being further characterized by (1) having said components (A), (B) and (C) each substantially completely dissolved in said water, (2) having the sum of the respective weight percentages of each of said components (A), (B) and (C) at least such that the viscosity of the resulting such composition is at least about 1000 centipoises as measured with a Brookfield viscometer using a #3 spindle at 60 revolutions per minute at about 24° C.

Surprisingly, in such compositions, the combination of sodium silicate and sodium alpha olefin sulfonate appears to coact with one another in a manner which may be considered to be synergistic to produce aqueous mixed solutions which are unexpectedly more viscous than is the viscosity of either of these agents alone in an aqueous solution of corresponding concentration. For example, a 20 weight percent aqueous solution of sodium alpha olefin sulfonate has a characteristic viscosity of less than about 10 centipoises as measured by a Brookfield viscometer using a #1 spindle at 60 revolutions per minute, at 24° C. while about a 20 weight percent aqueous solution of a sodium silicate having an $SiO_2$ to $Na_2O$ ratio of about 2.4:1 has a characteristic viscosity of less than about 15 centipoises similarly measured. However, when such relatively concentrated respective aqueous solutions are suitable admixed together in the presence of water of dilution, there is produced a composition of this invention as described above which has a viscosity of at least about 1000 centipoises. (Unless otherwise specifically indicated, all viscosity values herein are measured as above described.)

The present thickened cleaning compositions which result having such viscosities appear to be very useful for cleaning the surfaces above indicated. Surprisingly, such compositions do not need further thickening or cleaning agents added thereto, as is apparently common, for example, in prior art oven cleaning compositions, in order to achieve a commercially useful level of cleansing action although, of course, as those skilled in the art will readily appreciate, various known additives, if desired, may be formulated with a composition of this invention to enhance some type of cleansing action or to enhance product composition merchantability, provided such additives do not adversely interfere with the desired thickening action achieved by such an admixture as indicated.

The relatively high pH (typically above about pH 11) typically associated with compositions of this invention apparently results from the presence of the sodium silicate and such high pH appears to be one desirable factor in accounting for the cleaning action characteristically associated with surfactant containing compositions of this invention. No adverse effects of sodium silicate upon the sodium alpha olefin sulfonate appears to be involved.

The thickened compositions of this invention are all the more surprising in view of certain additional circumstances. Thus, for one thing, when one attempts to substitute for sodium silicate in a composition of this invention another alkali metal silicate, such as potassium silicate, no such corresponding thickening action is observed. In other words, such other silicate appears to be inoperative as thickening agent for coacting with sodium alpha olefin sulfonate in aqueous medium.

For another thing, when one attempts to substitute for sodium alpha olefin sulfonate another surfactant in an aqueous medium at comparable concentrations, it is believed that not only would no thickening action be achieved, but also such other surfactant would become insolubilized or chemically altered such that a precipitate would develop. No other surfactant other than sodium alpha olefin sulfonate is known to us which will stay in solution as a surfactant in the presence of such a concentration of sodium silicate and which will coact with sodium silicate to produce a thickened system.

Other and further objects, aims, purposes, features, advantages, embodiments, and the like will be apparent to those skilled in the art from the present teachings.

DETAILED DESCRIPTION

Figure 1:
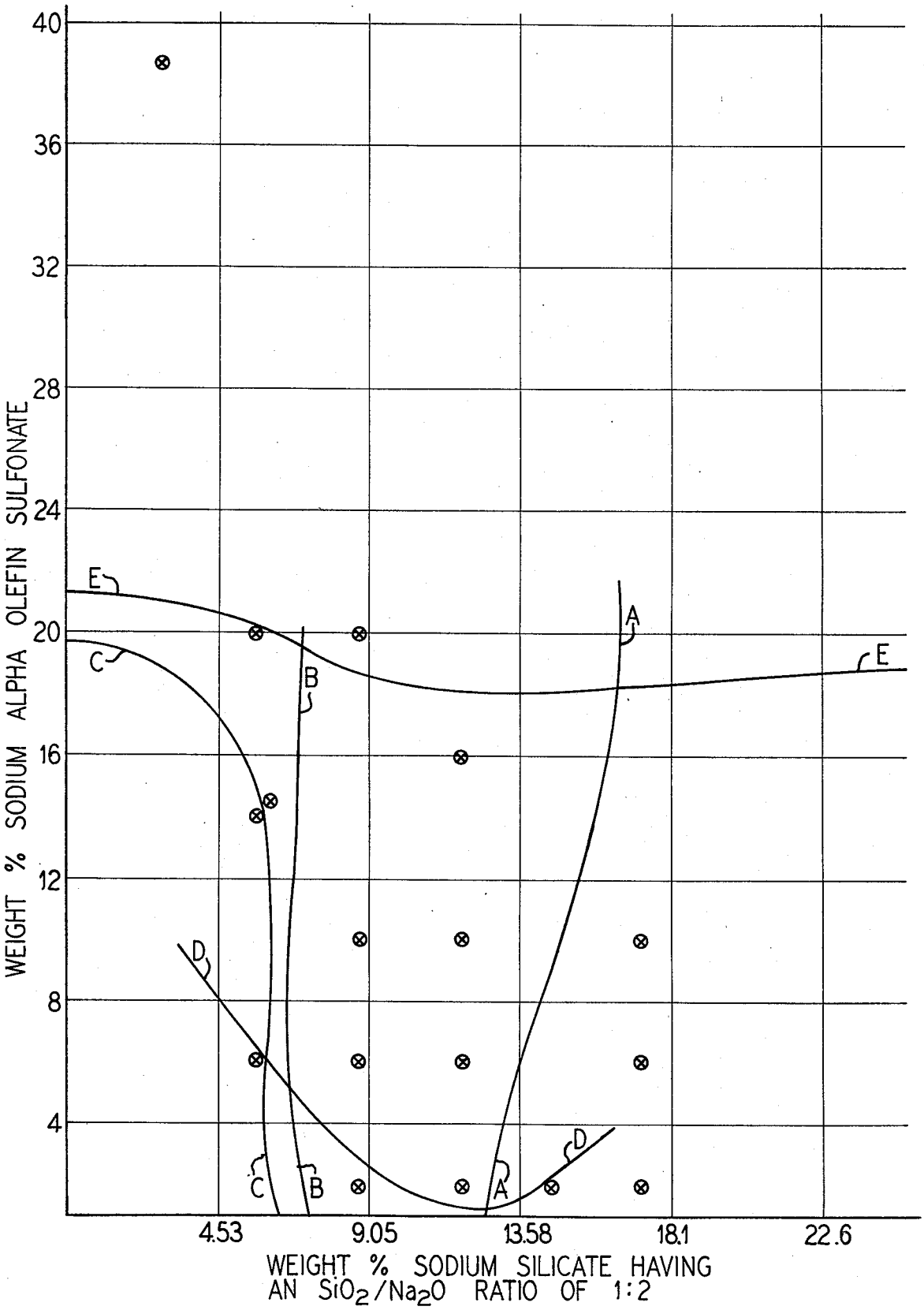
FIG. 1 is a plot showing the relationship between sodium alpha olefin sulfonate and sodium silicate having an $SiO_2$ to $Na_2O$ ratio of about 1:2 in aqueous solution at various respective concentrations with viscosity values being shown as measured for various respective concentration combinations.
Figure 2:
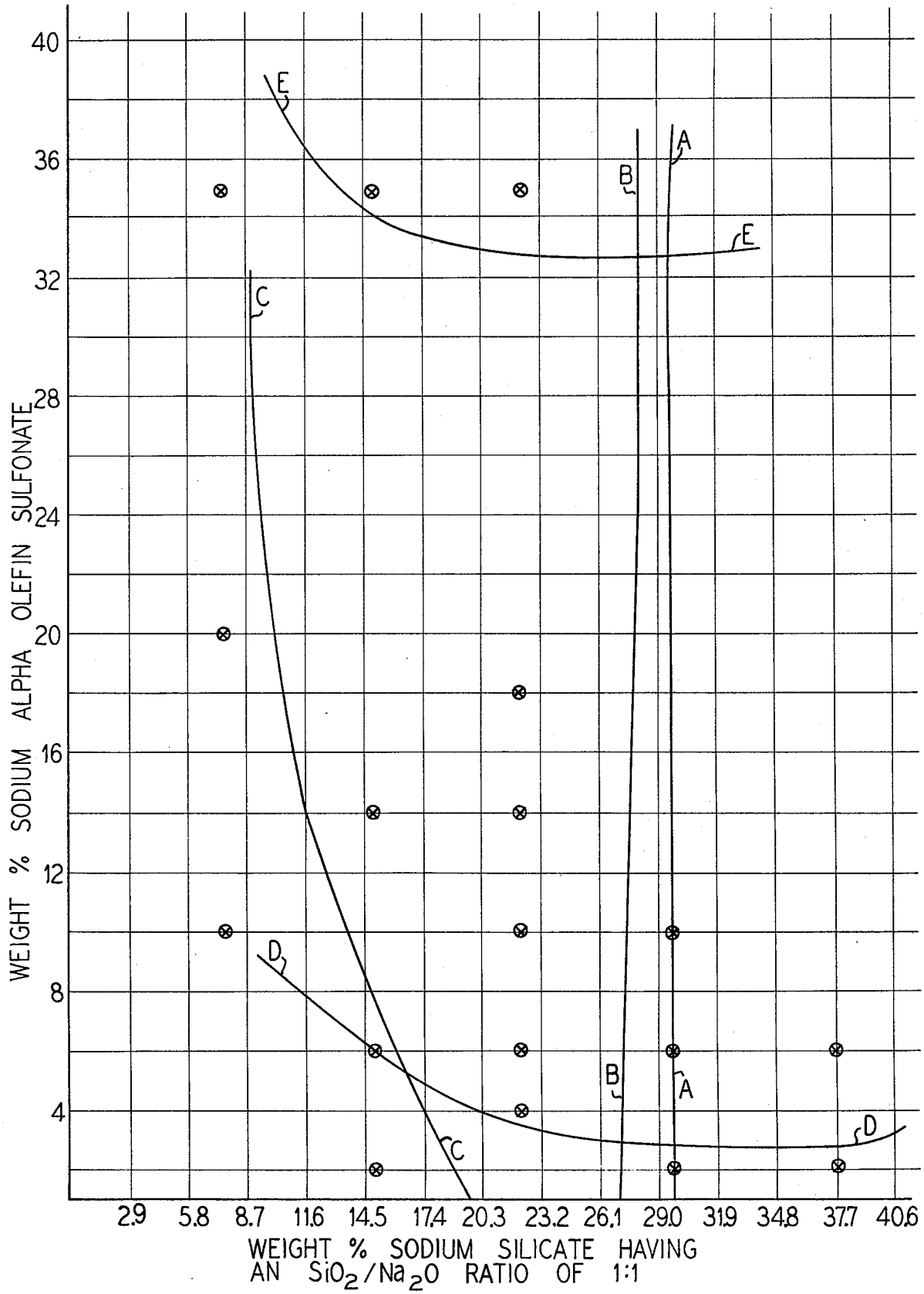
FIG. 2 is a plot similar to FIG. 1 except that the sodium silicate has an $SiO_2$ to $Na_2O$ ratio of about 1:1.
Figure 3:
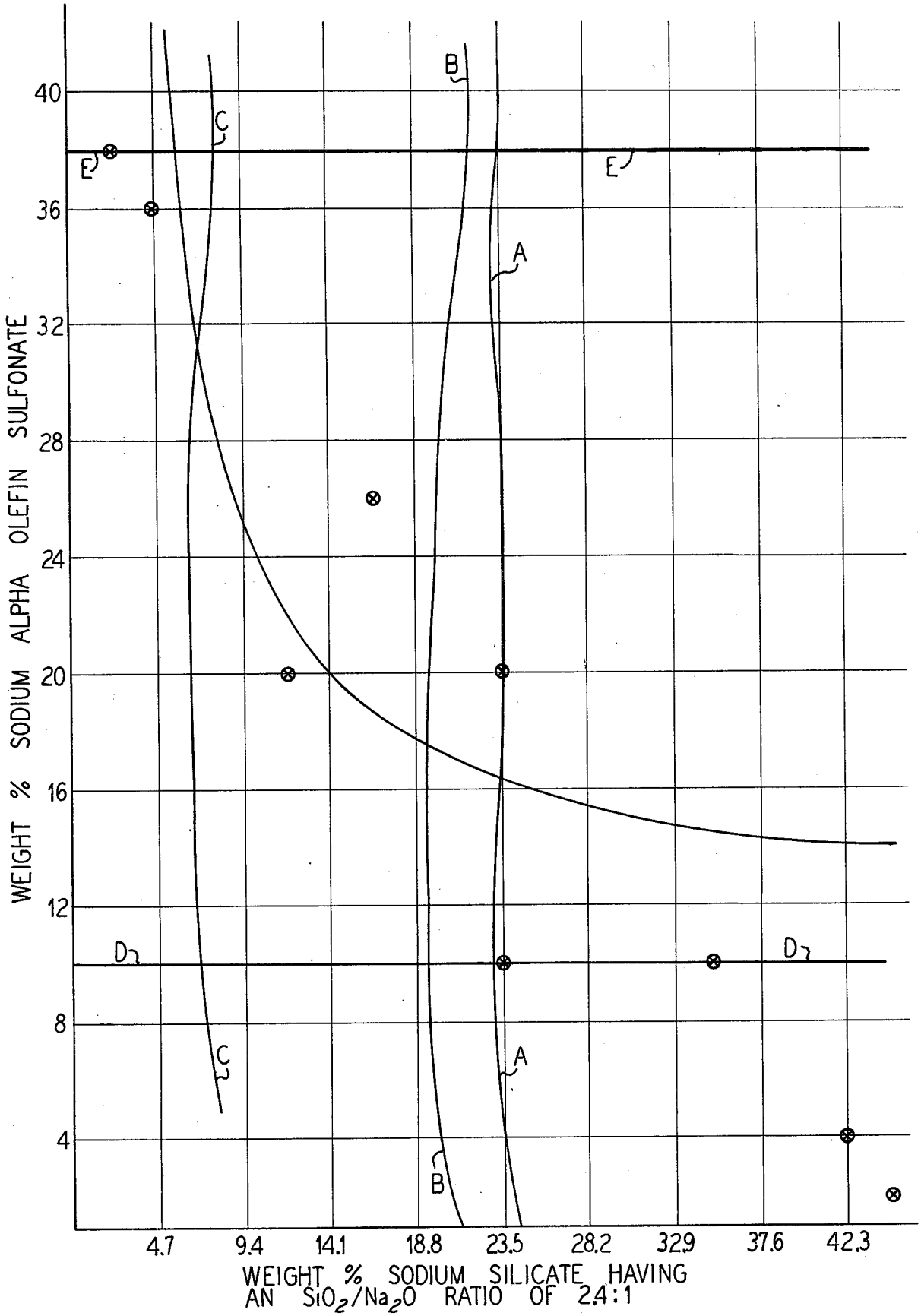
FIG. 3 is a plot similar to FIG. 1 except that the sodium silicate has an $SiO_2$ to $Na_2O$ ratio of about 2.4:1.

The sodium alpha olefin sulfonate employed in the practice of the present invention is preferably derived from at least one alpha olefin containing from 12 to 18 carbon atoms per molecule. Such surfactant is known well in the prior art and is made commonly by sulfonating such an alpha olefin following by bleaching and neutralization; it is available commercially as an aqueous solution. Preferably in the practice of the present invention, it is preferred to use as a starting sodium alpha olefin sulfonate one which has been previously prepared as an aqueous solution. One presently particularly preferred starting material is a 40 weight percent aqueous solution of sodium alpha olefin sulfonate, such as is available commercially from Stepan Chemical Company as "BIOTERGE AS-40". Preparation of this surfactant is well known and does not constitute as such a part of the present invention.

The sodium chloride and/or the sodium sulfate present in a product composition is one inherently derived from the commercial method of making sodium alpha olefin sulfonate, and it is not practical or necessary at the present time to purify a starting sodium alpha olefin sulfonate for use in the present invention by separating therefrom such small amounts of inorganic sodium salts particularly from the standpoints of cost and commercial practicality. For purposes of technical accuracy, the characteristic presence of such small amounts of inorganic sodium salts is here detailed (based upon "BioTerge AS-40").

The sodium silicate employed with practice of the present invention is preferably preliminarily obtained or prepared as an aqueous solution.

A composition of this invention as characterized above is prepared by any convenient procedure. One presently preferred procedure involves the steps of admixing together (a) a preformed aqueous solution of such sodium alpha olefin sulfonate containing also dissolved therein said salt and (b) a preformed aqueous solution of such sodium silicate in the presence of sufficient water to produce a product solution wherein the respective quantities of the components are as defined above and wherein the viscosity of such a product solution is at least about 1000 centipoises so measured as above indicated.

After mixing occurs of such respective preformed solutions, thickening or gelling takes place characteristically almost at once.

The exact amount of total solids comprising sodium alpha olefin sulfonate, sodium silicate and salt as described above needed to produce a viscosity in water of at least about 1000 centipoises possibly can vary from one system to another depending upon a number of compositional variations, so that an exact numerical value for this weight summation cannot now be accurately stated. In general, however, it now appears that this value will be in the range from about 20 to 30 weight percent of total solids based upon 100 percent by weight of a given homogeneous composition of this invention. A typical value of about 25 weight percent, then, is generally a minimum which is sufficient to produce a product composition having a viscosity of at least about 1000 centipoises measured as indicated above.

Homogeneous compositions of this invention can have viscosities extending over an extremely large range which extends or encompasses about 1000 to 100,000 centipoises (or even higher) measured as indicated above. Compositions in the approximate viscosity range of from about 2000 to 12,000 are regarded as pourable gels and presently constitute a class of preferred compositions of the present invention. For purposes of the present invention, a "gel" can be regarded generally as a viscous, jelly-like substance. Characteristically, gels of this invention are homogeneous; usually they are also clear, but some gels are translucent. Depending upon presently unknown compositional variations, it now appears that somewhere above about 12,000 to 15,000 centipoises, the initially pourable gels of this invention may typically become unpourable at ambient temperatures and pressures. However, the presently preferred gels as prepared are apparently clear up to about 100,000 centipoises and even higher.

For purposes of oven cleaning, it is presently most preferred to employ the gels in the viscosity range extending from about 5000 to 9500 centipoises, with viscosities in the range from about 6000 to 7000 centipoises being particularly preferred. However, as those skilled in the art appreciate, viscosity of an oven cleaner may be regarded as being more of a matter of taste or market appeal than a matter of technical significance bearing upon cleaning capability or the like. In general, a gel's viscosity should preferably be such that a composition of this invention as used for cleaning clings, or tends to cling, to the surfaces to be cleansed.

Gels of this invention which are not pourable are believed to still have excellent value as cleaning compositions since they can be applied by brushing, spraying, or the like to surfaces to be cleansed and good adherence characteristics to surface deposits is observed with compositions of this invention generally. Such surfaces can include vitreous enamel, stainless steel, and the like, as desired. Good cleaning action with all compositions of the invention is characteristically observed.

For reasons not now clear, some gels of this invention, especially those with initial viscosities typically apparently over about 12,000 to 15,000 centipoises, can, on standing, slowly convert to white, opaque pastes. For present purposes, the term "paste" has reference to a soft, viscous mass of solids dispersed in a liquid. Like the gels, such pastes are believed to have excellent value as cleaning compositions, since they can be applied by brushing, spraying, or the like to surfaces to be cleansed and similar good surface deposit adherence characteristics are observed, and also good cleaning action is achieved.

A homogeneous composition of this invention preferably has incorporated therewith, as by mixing or the like during manufacture, from about 10 to 20 weight percent (total composition weight basis) of a sodium silicate having an $SiO_2$ to $Na_2O$ weight ratio of from about 2.4:1 to 1:2. Preferably the sodium silicate is in a previously prepared and dissolved condition at the time of use in a composition of this invention.

One presently particularly preferred sodium silicate starting material is one wherein the $SiO_2$ to $Na_2O$ weight ratio is about 1:1 (meta silicate) available commercially under the trade designation "Metso Pentabead 20" from Philadelphia Quartz of Valley Forge, PA.

Another presently particularly preferred sodium silicate starting material has an $SiO_2$ to $Na_2O$ weight ratio of about 1:2 (ortho silicate) available commercially under the trade designation "Dryorth" from Stauffer Chemical Co. of Westport, Conn.

Still another presently particularly preferred sodium silicate starting material is a 47 weight percent aqueous solution of sodium silicate wherein the $SiO_2$ to $Na_2O$ weight ratio is about 2.4:1, such as is available commercially under the trade designation "RU Silicate" from Philadelphia Quartz of Valley Forge, PA.

Sodium silicates having an $SiO_2$ to $Na_2O$ weight ratio of from about 1:1 to 1:2 appear to have the effect of making a product composition of this invention be strongly alkaline. When the $SiO_2$ to $Na_2O$ weight ratio is greater than about 1:1, a product compositions alkalinity is reduced, but such a sodium silicate reduces the ability of a composition of this invention to attack and corrode a soft metal when applied thereto as in a cleaning operation. By the term "soft metal" as used herein, reference is had to a metal or metal alloy at least 50 weight percent of which is comprised of at least one metal above the level of iron on the electromotive series of metals. Examples of common soft metals include aluminum, tin, zinc, and the like. Mixtures of silicates having differing $SiO_2$ to $Na_2O$ weight ratios can be employed.

One class of useful compositions of this invention can be used either as a cleaning composition (of metal, enamel, or similar surfaces) or as an intermediate for the manufacture of other, more viscous compositions, such as especially the presently preferred clear pourable gel compositions above referenced. Compositions of such one class preferably have a viscosity in the range from about 1000 to 2000 centipoises and are in the form of pourable liquids. Such a composition comprises (on a 100 weight percent total composition basis):

(A) from about 7 to 16 weight percent of such sodium alpha olefin sulfonate,
(B) from about 0.35 to 0.8 weight percent of such salt,
(C) from about 7.5 to 13 weight percent of such a sodium silicate having an $SiO_2$ to $Na_2O$ weight ratio of 3.2:1 to 1:2, and
(D) from about 70.2 to 85 weight percent of water.

Here the sum of (A), (B) and (C) in any given composition, each component being dissolved in the water, ranges from about 15 to 52 weight percent.

When a composition within the class of preferred clear gels having a viscosity of 2,000 to 30,000 centipoises is involved such comprises on a 100 weight percent total composition basis:

(A) from about 7 to 19 weight percent of such sodium alpha olefin sulfonate,
(B) from about 2.35 to 1.5 weight percent of such salt,
(C) from about 6 to 16 weight percent such a sodium silicate having an $SiO_2$ to $Na_2O$ weight ratio of 1:1 to 1:2, and
(D) from about 50 to 87 weight percent of water.

Here, the sum of (A), (B) and (C) in any given composition, such components each being dissolved in the water, ranges from about 13.3 to 36.5 weight percent.

When a homogeneous opaque paste composition having a viscosity ranging from about 15,000 to 50,000 centipoises is involved, such comprises on a 100 weight percent total composition basis:

(A) from about 10 to 17 weight percent of said sodium alpha olefin sulfonate,
(B) from about 0.5 to 0.85 weight percent of said salt,
(C) from about 6 to 12.0 weight percent of said sodium silicate having an $SiO_2$ to $Na_2O$ weight ratio of 1:1 to 1:2, and
(D) from about 70.15 to 84 weight percent of said water.

Here, the sum of (A), (B) and (C) in any given composition, such components each being dissolved in the water, ranges from about 16.5 to 31.4 weight percent.

In cleaning a surface contaminated with waste carbonaceous deposits using a homogeneous composition of this invention, the following steps are typically followed:

(A) applying to such so contaminated surface a composition of this invention;
(B) allowing the so treated surface to stand for a time at least sufficient to loosen such deposits therefrom; and
(C) washing the resulting surface to remove such loosened deposits and such composition therefrom.

Applying may be accomplished by any convenient procedure, including brushing, spraying, or the like. Standing time can vary but typically and preferably should be at least about 60 minutes. Washing can be accomplished with tap water only, but a detergent can be used if desired. Sometimes the steps above indicated need to be repeated to effectuate a complete removal of deposits.

The surface so cleaned can be metal (stainless steel, aluminum, copper or the like) or enameled metal, such as a vitreous enamel. The compositions of this invention are well suited for use in oven cleaning or in cleaning food processing equipment.

To use as an intermediate composition for preparing compositions of higher viscosity a composition having a viscosity of from about 1000 to 2000 centipoises (all as above characterized), one can simply admix together such an intermediate composition and at least one of the following:

(A) a preformed solution of said sodium alpha olefin sulfonate containing also dissolved therein said salt, and
(B) a preformed solution of sodium silicate having an $SiO_2$ to $Na_2O$ weight ratio ranging from about 1:1 to 1:2 in the presence of sufficient water to produce a product solution which is preferably in the form of a gel having a viscosity ranging from about 2,000 to 30,000 centipoises.

Before such an admixing is accomplished, one can dissolve in the intermediate compositions other agents, if desired, such as an amphoteric surfactant, a betaine, a hydrotope or other agent, if desired, care being taken not to adversely offset the thickening action between sodium alpha olefin sulfonate and sodium hydroxide.

The compositions of this invention can be formulated into aerosols. For example, from about 50 to 85 weight percent of a pourable gel composition of this invention can be compounded with from about 15 to 50 weight percent of a fluorocarbon or other inert propellant on a 100 weight percent total composition basis to make a sprayable mixture in a pressurized valve-equipped aerosol-type dispensing container.

It is presently preferred to use a weight ratio of sodium alpha olefin sulfonate to sodium silicate in compositions of this invention ranging from about 1:5 to 5:1.

Compositions of the present invention can be used as cleaning compositions even when such are in a solid or semi-solid (e.g. paste, gel or the like) form at room temperatures. Thus, for example, a solid composition can be warmed and converted into a softer state suitable for application by painting, brushing, spraying or the like.

EMBODIMENTS

The following examples are merely illustrations of the present invention and are not intended as a limitation upon the scope thereof.

Starting Materials:

EXAMPLE A

"BIOTERGE AS-40" from Stepan Chemical Company 40 weight percent sodium alpha olefin sulfonate, containing about 0.67 weight percent NaCl and about 1.33 weight percent $Na_2SO_4$ with the balance to 100 weight percent being water.

EXAMPLE B

A 47 weight percent aqueous solution of sodium silicate is obtained commercially ad "RU Silicate" from Philadelphia Quartz, Valley Forge, PA; this silicate has an $SiO_2$ to $Na_2O$ weight ratio of 2.4:1.

EXAMPLE C

Solid crystals of sodium metasilicate pentahydrate having an $SiO_2$ to $Na_2O$ weight ratio of 1:1 is obtained commercially from Philadelphia Quartz as "Metso Pentabead 20". Such crystals are dissolved in water to make solutions for use in the Examples below.

EXAMPLE D

Solid crystals of sodium orthosilicate having an $SiO_2$ to $Na_2O$ weight ratio of 1:2 is obtained commercially from Stauffer Chemical, as "DRYORTH". Such crystals are dissolved in water to make solutions for use in the Examples below.

EXAMPLE E

Figure 4:
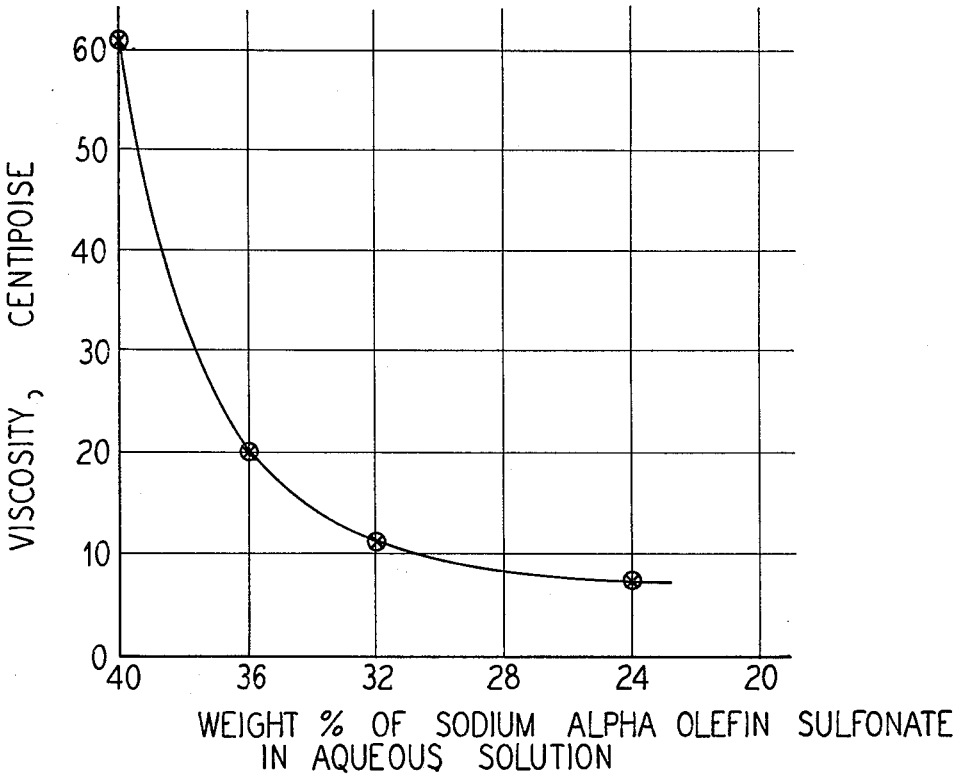
FIG. 4 is a plot showing the relationship between aqueous solution concentration and viscosity for sodium alpha olefin sulfonate.

The viscosity of various respective aqueous solutions of sodium alpha olefin sulfonate (based on derived solutions from Example A) is measured and the results are tabularized below and also are plotted in FIG. 4 herewith. Viscosity is measured in centipoises determined by use of a Brookfield viscometer operated at 60 revolutions per minute with a #1 spindle at about 24° C.

TABLE I

| weight percent Na A OS solids* | viscosity in centipoises |
|---|---|
| 40 | 61 |
| 36 | 20 |
| 32 | 11 |
| 24 | 7 |

*"Na AOS" has reference herein to sodium alpha olefin sulfonate.

EXAMPLE F

Figure 5:
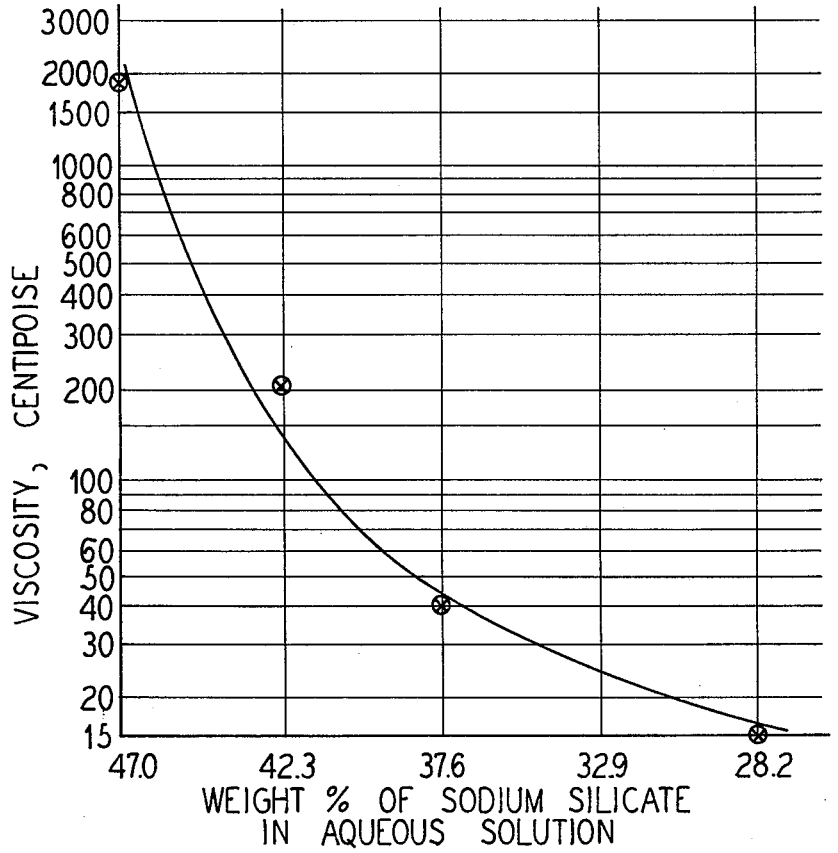
FIG. 5 is a plot showing the relationship between aqueous solution concentration and viscosity for sodium silicate having an $SiO_2$ to $Na_2O$ ratio of about 2.4:1.

The viscosity of various aqueous solutions of sodium silicate having an $SiO_2$ to $Na_2O$ weight ratio of 2.4:1 (based on derived solutions from Example B) is measured and the results are tabularized below and also are plotted in FIG. 5 herewith. Viscosity is measured for the 47 weight percent starting solution using a Brookfield viscoimeter operated at 12 revolutions per minute with a #2 spindle at about 24° C. Then for the 42.3 weight percent solution the spindle operated at 60 revolutions per minute is used. For the final 2 solutions, spindle #1 operated at 60 revolutions per minute is employed.

TABLE II

| weight percent sodium silicate 2.4:1 solids | viscosity (centipoises) |
|---|---|
| 47.0 | 1900 |
| 42.3 | 200 |
| 37.6 | 40 |
| 28.2 | 15 |

COMPOSITIONS OF THE INVENTION

EXAMPLE 1

A gel is made from the alpha olefin sulfonate of Example A and the sodium silicate of Example C to produce the following composition:

| | wt. % (solution basis) | 100 wt. % |
|---|---|---|
| sodium alpha olefin sulfonate (Example A) | 50 | 20 |
| sodium silicate (Example C) | 26 | 15.1 |
| water | 24 | 64.9 |

The sodium silicate is preliminarily dissolved in the water by stirring and heating to about 50° to 60° C. and the sodium alpha olefin sulfonate is then added. The warm resulting mixture is then stirred until homogeneous and allowed to cool to room temperature (about 24° C.). The viscosity of the starting sodium silicate solution is estimated to be approximately equal to that of tap water. The viscosity of this cooled mixture is over about 100,000 centipoises and is in the form of a substantially clear unpourable gel.

EXAMPLES 2–18

Using the procedure of Example 1, a series of sodium alpha olefin sulfonate/sodium slicate mixtures in water are prepared using the same type of sodium silicate. The results are summarized in Table III below:

TABLE III

| Example No. | wt. % solids Na AOS | wt. % solids sodium metasilicate | wt. % $H_2O$ | 24° C. Viscosity (Centipoises) | Appearance |
|---|---|---|---|---|---|
| 2 | 2 | 14.9 | 83.1 | 15 | clear liquid |
| 3 | 2 | 29.7 | 68.3 | — | clear 2 phase liquid |
| 4 | 2 | 37.7 | 60.3 | — | cloudy 2 phase liquid |
| 5 | 4 | 22.3 | 73.7 | 16,000 | clear initially, pourable gel, crystals in 1 month |
| 6 | 6 | 14.9 | 79.1 | 580 | hazy ppt formed in 3 mo. |
| 7 | 6 | 22.3 | 71.7 | 40,000 | clear gel initially |
| 8 | 6 | 29.7 | 64.3 | 6,500 | cloudy gel initially pourable |
| 9 | 6 | 37.7 | 56.3 | 5,200 | cloudy gel initially |
| 10 | 10 | 7.4 | 82.6 | 15 | clear liquid ppt formed in 3 months |
| 11 | 10 | 22.3 | 67.7 | 16,000 | clear initially pourable gel converts to paste slowly |
| 12 | 10 | 29.7 | 60.3 | 740 | cloudy |
| 13 | 14 | 14.9 | 71.1 | >100,000 | clear gel initially |
| 14 | 14 | 22.3 | 63.7 | 45,000 | clear gel initially |
| 15 | 18 | 22.3 | 59.7 | 23,500 | clear gel initially |
| 16 | 20 | 7.4 | 72.6 | 345 | clear liquid |
| 17 | 20 | 7.4 | 72.6 | 345 | clear liquid |
| 18 | 34.9 | 7.4 | 57.7 | >100,000 | hazy gel initially |

EXAMPLES 19–35

Using the procedure of Example 1 but employing as the sodium silicate the ortho silicate of Example D instead, a series of sodium alpha olefin sulfonate mixtures in water with this silicate are prepared. The results are summarized in Table IV below:

TABLE IV

| Example No. | wt. % solids Na AOS | wt. % solids sodium orthosilicate | wt. % $H_2O$ | 24° C. Viscosity (Centipoises) | Appearance |
|---|---|---|---|---|---|
| 19 | 2 | 8.8 | 89.2 | 15 | clear liquid initially |
| 20 | 2 | 11.8 | 86.2 | 1,200 | clear pourable gel initially |
| 21 | 2 | 14.5 | 83.5 | 415 | cloudy liquid |
| 22 | 2 | 17.2 | 80.8 | — | 2 phase liquid |
| 23 | 6 | 5.7 | 88.3 | 10 | clear |
| 24 | 6 | 8.8 | 85.2 | — | clear |
| 25 | 6 | 11.8 | 82.2 | 8,700 | hazy pourable gel initially |
| 26 | 6 | 17.2 | 76.8 | 2,750 | cloudy pourable gel initially |
| 27 | 10 | 8.8 | 81.2 | — | clear |
| 28 | 10 | 11.8 | 78.2 | 70,000 | into hazy gel initially separates 2 phase liquid |
| 29 | 10 | 12.2 | 77.8 | 3,600 | into hazy gel initially separates 2 phase liquid |
| 30 | 14 | 5.7 | 80.3 | 450 | clear liquid |
| 31 | 14.5 | 6.1 | 79.4 | 850 | hazy liquid |
| 32 | 16 | 22.8 | 16.2 | >100,000 | hazy unpourable gel |
| 33 | 20 | 5.7 | 74.3 | 38,500 | clear gel |
| 34 | 20 | 8.8 | 71.2 | >100,000 | clear unpourable gel |
| 35 | 38.7 | 2.9 | 58.4 | 28,500 | clear gel |

EXAMPLE 36

A gel is made from the alpha olefin sulfonate of Example A and the sodium silicate of Example B to produce the following composition:

| | wt. % (solution basis) | wt. % (solids basis) |
|---|---|---|
| sodium alpha olefin sulfonate of Example A | 75 | 30 |
| sodium silicate of Example B | 25 | 11.75 |
| water | 25 | 58.25 |

The sodium silicate solution is admixed with the water and the sodium alpha olefin sulfonate solution is added to the resulting diluted system with stirring. The product has a viscosity of about 2500 centipoises and is in the form of a hazy gel initially.

EXAMPLES 37–45

Using the procedure of Example 36, a series of mixtures are prepared. The results are summarized in Table V below:

TABLE V

| Example # | wt. % solids Na AOS | wt. % sodium silicate | wt. % $H_2O$ | cps. @ 24° C. Viscosity | Appearance |
|---|---|---|---|---|---|
| 36 | 2 | 44.7 | 53.3 | — | 2 phase liquid |
| 37 | 4 | 42.3 | 53.7 | — | 2 phase liquid |
| 38 | 10 | 35.3 | 54.7 | — | 2 phase liquid |
| 39 | 10 | 23.5 | 25 | 110 | hazy liquid |
| 40 | 20 | 23.5 | 56.5 | 7,800 | cloudy gel initially pourable |
| 41 | 20 | 11.8 | 25 | 20 | hazy liquid |
| 42 | 26 | 16.5 | 57.5 | 11,600 | hazy gel initially pourable |
| 43 | 36 | 4.7 | 59.3 | 785 | cloudy liquid |
| 44 | 38 | 2.4 | 59.6 | 95 | cloudy liquid |
| 45 | 38 | 2.4 | 59.6 | 100 | cloudy liquid |

When in Tables III, IV and V, reference is made to a two phase system, it will be appreciated that such a system is not included within the scope of homogeneous compositions of this invention.

When the data of Examples 1–45 is plotted with silicates as abscissae and with Na AOS as ordinates, with corresponding viscosity values marked over each data point, the respective plots shown in FIGS. II, I, and III for the metasilicate, orthosilicate and the RU silicate, respectively, result.

(A) In each of the FIGS. I, II, and III, all points to the right of line A indicate product mixtures which were not homogeneous or were cloudy initially.

(B) All points between line A and line B indicate product mixtures which were homogeneous and clear initially. However, within 6 months, almost all of such mixtures converted to white pastes.

(C) All points to the left of line B indicate product mixtures which were clear and homogeneous initially and which remained clear and homogeneous over at least a 6 month period.

(D) All points to the left of line C indicate product mixtures which had viscosities below about 1000 centipoises initially and which retained this viscosity over a 6 month period.

(E) All points below line D indicate product mixtures which had viscosities below about 1000 centipoises initially and which retained such viscosities over a six month period.

(F) All points above line E indicate product mixtures which had viscosities above about 100,000 centipoises initially and which retained high viscosities over a six month period.

The points between lines A and C and between lines D and E are thus considered to represent compositions with the scope of the present invention useful as oven cleaners.

Each of the compositions between lines A and C and D and E is useful as an oven cleaner.

All points to the left of line C indicate product mixtures which had viscosities below about 1000 centipoises initially and which retained such viscosities over a 6 month period.

The points (area) between lines A and C and between lines D and E are thus considered to represent compositions within the scope of the present invention in each of FIGS. III, IV and V. When such compositions contain at least about 70 weight percent water.

Each of the compositions between lines A and C and lines D and E is useful as an oven cleaner in FIGS. III, IV and V.

EXAMPLE 46

About 80 weight percent of the formulation of Example 8 above is charged with a pressurizable valve-equipped aerosol-type dispensing container and the container is charged with about 20 weight percent (on a 100 weight percent total composition weight basis) of a fluid of isobutane and propane as a propellant to produce an aerosol type oven cleaner.

EXAMPLE 47

The composition of Example 34 which (as shown) has viscosity in excess of 100,000 centipoises at room temperature is warned to about 130° F. and the resulting viscosity is reduced to about 910 centipoises when the system is classified as a clear pourable gel. On cooling to room (ambient) temperatures, this gel resolidifies to its initial condition. This gel is suitable for cleaning by an application procedure involving brushing, spraying or the like to a surface to be cleansed of deposited carbonaceous matter. Following application to a surface at ambient temperature, the so warmed gel cools and solidifies which can be considered to be advantageous, since, on a vertical or overhead surface, running does not occur with the solidified system.

The surprising and unexpected viscosity increase associated with compositions of this invention (as shown, for instance, in Examples 40 and 42) compared to the viscosities associated with the individual component solutions (as shown, for instance, in Examples A and B) is believed to represent a type of synergistic coaction between the sodium alpha olefin sulfonate and the sodium silicate.

Because of the circumstance that it is desired to make thickened sodium silicate/sodium alpha olefin sulfonate compositions which contain a maximum quantity of water with a minimum of dissolved solids, the novel compositions of this invention are chosen so as to contain a minimum amount of water of 70 weight percent as hereinabove taught. Such compositions are believed not to have been previously taught or suggested in the prior art. See, for example, Shultz et al U.S. Pat. No. 4,111,853. However, the practice of oven cleaning and removal of carbonaceous deposits from contaminated surfaces as taught herein can be accomplished by using compositions of sodium silicate and sodium alpha olefin sulfonate in aqueous solution which contain higher than 30 weight percent solids concentrations as hereinabove taught.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, except as it is set forth in the hereto-appended claims.

We claim as our invention:

1. A homogeneous composition for oven cleaning and the like comprising on a 100 weight percent total composition basis:

(A) from about 3 to 14 weight percent of a sodium alpha olefin sulfonate derived from at least one alpha olefin containing from 12 to 18 carbon atoms per molecule, (B) from about 0.15 to 0.7 weight percent of salt selected from the group consisting of sodium chloride and sodium sulfate, (C) from about 7 to 15 weight percent of sodium silicate having an $SiO_2$ to $Na_2O$ weight ratio of from 3.2:1 to 1:2, and (D) from about 70.3 to 90 weight percent of water, said composition being further characterized by (1) having said components (A), (B) and (C) each substantially completely dissolved in said water, and (2) having the sum of the respective weight percentages of each of said components (A), (B) and (C) at least such that the viscosity of the resulting such composition is at least about 1000 centipoises as measured with a Brookfield viscometer using a #3 spindle at 60 revolutions per minute at about 24° C.

2. The homogeneous composition of claim 1 wherein said sum is at least about 15 weight percent on a 100 weight percent total composition basis.

3. The homogeneous composition of claim 1 wherein said composition viscosity ranges from about 1000 to 100,000 centipoises as so measured.

4. The homogeneous composition of claim 1 wherein the weight ratio of sodium silicate to sodium alpha olefin sulfonate ranges from 5:1 to 1:5.

5. The homogeneous composition of claim 1 in the form of a pourable liquid comprising on a 100 weight percent total composition basis:

(A) from about 7 to 16 weight percent of said sodium alpha olefin sulfonate, (B) from about 0.35 to 0.8 weight percent of said salt, (C) from about 7.5 to 13 weight percent of said sodium silicate, and (D) from about 70.2 to 85.15 weight percent of said water, said sum being in the range from about 14.85 to 29.8 weight percent, said composition viscosity being in the range from about 1000 to 2000 centipoises as so measured.

6. The homogeneous composition of claim 1 in the form of a clear gel comprising on a 100 weight percent total composition basis:

(A) from about 7 to 16 weight percent of said sodium alpha olefin sulfonate, (B) from about 0.35 to 0.8 weight percent of said salt, (C) from about 7.5 to 13 weight percent of said sodium silicate, and (D) from about 70.2 to 85 weight percent of said water, said sum being in the range from about 13.35 to 29.95 weight percent, said composition viscosity being in the range from about 2,000 to 30,000 centipoises as so measured.

7. The homogeneous composition of claim 1 in the form of an opaque paste comprising on a 100 weight percent total composition basis:

(A) from about 10 to 17 weight percent of said sodium alpha olefin sulfonate, (B) from about 0.5 to 0.85 weight percent of said salt, (C) from about 6 to 12 weight percent of said sodium silicate, (D) from about 70.15 to 84 weight percent of said water, said sum being in the range from about 16.5 to 29.85 weight percent, said composition viscosity being in the range from about 15,000 to 50,000 centipoises as so measured.

8. A process for cleaning a surface contaminated with waste proteinaceous deposits comprising the steps of (A) applying to such so contaminated surface a composition of sodium alpha olefin sulfonate and sodium silicate having an $SiO_2$ to $Na_2O$ weight ratio of from 3.2:1 to 1:2 dissolved in water, (B) allowing the so treated surface to stand for a time at least sufficient to loosen said deposits therefrom, (C) washing the resulting surface to remove such loosened deposits and such composition therefrom.

9. The process for cleaning of claim 8 wherein said surface is a vitreous enamel.

10. The process of claim 9 wherein said surface is in an oven.

11. The process of claim 8 wherein said surface is stainless steel.

12. The process of claim 11 wherein said surface is in a milk holding tank employed in pasteurization.

13. A process for cleaning a surface contaminated with waste proteinaceous deposits comprising the steps of (A) applying to such so contaminated surface a gel composition of claim 6, (B) allowing the so treated surface to stand for a time at least sufficient to loosen said deposits therefrom, (C) washing the resulting surface to remove such loosened deposits and such composition therefrom.

14. A process for cleaning a surface contaminated with waste proteinaceous deposits comprising the steps of (A) applying to such so contaminated surface a paste composition of claim 7, (B) allowing the so treated surface to stand for a time at least sufficient to loosen said deposits therefrom, (C) washing the resulting surface to remove therefrom such loosened deposits and such composition.

15. A process for making a composition of claim 1 comprising the steps of admixing together (a) a preformed aqueous solution of said sodium alpha olefin sulfonate containing also dissolved therein said salt and (b) a preformed aqueous solution of said sodium silicate in the presence of sufficient water to produce a product solution wherein the respective quantities of the components are as defined in claim 1 and wherein the viscosity of such product solution is at least about 1000 centipoises as so measured.

16. The process of claim 15 wherein said product solution has a viscosity ranging from about 2000 to 10,000 centipoises and is in the form of a gel.

17. A process for making a composition of claim 5 comprising the step of admixing together a preformed aqueous solution of said sodium alpha olefin sulfonate containing also dissolved therein said salt and a preformed aqueous solution of said sodium hydroxide in the presence of sufficient water to produce a product solution wherein the respective quantities of the components are as defined in claim 5 and wherein the viscosity of such product solution ranges from about 1000 to 2000 centipoises as so measured.

18. A process for making a composition of claim 6 comprising the step of admixing together with the homogeneous composition which comprises on a 100 weight percent total composition basis:

(A) from about 7 to 16 weight percent of a sodium alpha olefin sulfonate derived from at least on alpha olefin containing from 12 to 18 carbon atoms per molecule, (B) from about 0.35 to 0.8 weight percent of salt selected from the group consisting of sodium cloride and sodium sulfate, (C) from about 7.5 to 13 weight percent of sodium silicate having an $SiO_2$ to $Na_2O$ weight ratio of from 3.2:1 to 1:2, and (D) from about 70.2 to 85.13 weight percent of water, said composition being further characterized by:

(1) having said components (A), (B), (C), and (D) each substantially completely dissolved in said water, and (2) having the sum of the respective weight percentages of each of said components (A), (B), (C), and (D) being in the range from about 14.85 to 29.8 weight percent, the viscosity of the resulting such compsition being in the range of from about 1000 to 2000 centipoises as measured with a Brookfield viscometer using a #3 spindle at 60 revolutions per minute at about 24° C., an amount which is sufficient to produce said composition of claim 6 of at least one of the following:

(A) a preformed solution of said sodium alpha olefin sulfonate containing also dissolved therein said salt, and (B) a preformed solution of said sodium hydroxide, in the presence of sufficient water to produce a product solution in the form of a gel having a viscosity ranging from about 2,000 to 30,000 centipoises.

19. A homogeneous gel composition for oven cleaning and the like comprising on a 100 weight percent total composition basis:

(A) from about 7 to 16 weight percent of a sodium alpha olefin sulfonate derived from at least one alpha olefin containing from 14 to 18 carbon atoms per molecule, (B) from about 0.35 to 0.8 weight percent of salt selected from the group consisting of sodium chloride and sodium sulfate, (C) from about 75 L to 13 weight percent of sodium silicate having an $SiO_2$ to $Na_2O$ weight ratio of 1:1 to 1:2, and (D) from about 70.2 to 85 weight percent water, said components (A), (B) and (C) each being substantially completely dissolved in said water, and the total weight percentage of said components (A), (B) and (C) being at least about weight percent in any given such composition, said composition having a viscosity ranging from about 2,000 to 30,000 as measured with a Brookfield viscometer using a #3 spindle at 12 revolutions per minute at about 24° C.

20. The gel composition of claim 19 wherein said viscosity ranges from about 5000 to 9500 so measured.

* * * * *